US008253046B2

(12) United States Patent
Chen et al.

(10) Patent No.: US 8,253,046 B2
(45) Date of Patent: Aug. 28, 2012

(54) KEYPAD ASSEMBLY FOR ELECTRONIC DEVICES

(75) Inventors: Jian-Hui Chen, Shenzhen (CN); Ming-Zhi Zheng, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 296 days.

(21) Appl. No.: 12/755,494

(22) Filed: Apr. 7, 2010

(65) Prior Publication Data

US 2011/0024277 A1 Feb. 3, 2011

(30) Foreign Application Priority Data

Jul. 31, 2009 (CN) ..... 2009 2 0307161 U

(51) Int. Cl.
*H01H 9/26* (2006.01)

(52) U.S. Cl. ..... 200/5 A

(58) Field of Classification Search ..... 200/5 A, 200/310, 317, 311–314, 341, 510–520, 344, 200/345

See application file for complete search history.

(56) References Cited

U.S. PATENT DOCUMENTS

| | | | | |
|---|---|---|---|---|
| 5,612,692 | A * | 3/1997 | Dugas et al. | 341/22 |
| 6,462,294 | B2 * | 10/2002 | Davidson et al. | 200/512 |
| 6,977,352 | B2 * | 12/2005 | Oosawa | 200/314 |
| 6,984,799 | B2 * | 1/2006 | Kawaguchi et al. | 200/512 |
| 7,411,143 | B2 * | 8/2008 | Shin et al. | 200/314 |
| 7,935,904 | B2 * | 5/2011 | Song | 200/310 |
| 2010/0018848 | A1 * | 1/2010 | Cao | 200/5 A |

* cited by examiner

*Primary Examiner* — Edwin A. Leon
(74) *Attorney, Agent, or Firm* — Altis Law Group, Inc.

(57) ABSTRACT

A keypad assembly includes a pressing cover, a keypad and a shading plate. The button cover includes a plurality of buttons. The keypad includes a plurality of key bodies respectively corresponding to the buttons. A plurality of posts are arranged on the keypad. The shading plate is positioned on the keypad and is supported by the posts. The shading plate is positioned under the buttons for preventing light leakage.

11 Claims, 4 Drawing Sheets

KEYPAD ASSEMBLY FOR ELECTRONIC DEVICES

BACKGROUND

1. Technical Field

The present disclosure generally relates to keypad assemblies, particularly to a keypad assembly for electronic devices.

2. Description of Related Art

A typical key assembly usually includes a keypad, a light guide plate, an elastic member, a metallic dome sheet, a plurality of metallic domes, and a printed circuit board (PCB). In use, when any of the key buttons of the keypad is pressed down, the key button deforms accordingly. A bottom of the key button presses a corresponding metallic dome to touch a fixed contact point, so that an electronic signal is generated.

However, the typical key assembly easily leaks light from key buttons. Additionally, due to need for these various components, the typical keypad assembly is unduly bulky, complicated and therefore costly to manufacture.

Therefore, there is room for improvement within the art.

BRIEF DESCRIPTION OF THE DRAWINGS

Many aspects of the disclosed key assembly can be better understood with reference to the following drawings. The components in the drawings are not necessarily drawn to scale, the emphasis instead being placed upon clearly illustrating the principles of the present key assembly.

DETAILED DESCRIPTION

The disclosed control assembly may be applied in portable electronic devices such as mobile phones or personal digital assistants (PDA) in accordance with an exemplary embodiment. In the exemplary embodiment, the key assembly used in a mobile phone is illustrated, although the disclosure is not limited thereto.

Figure 1:
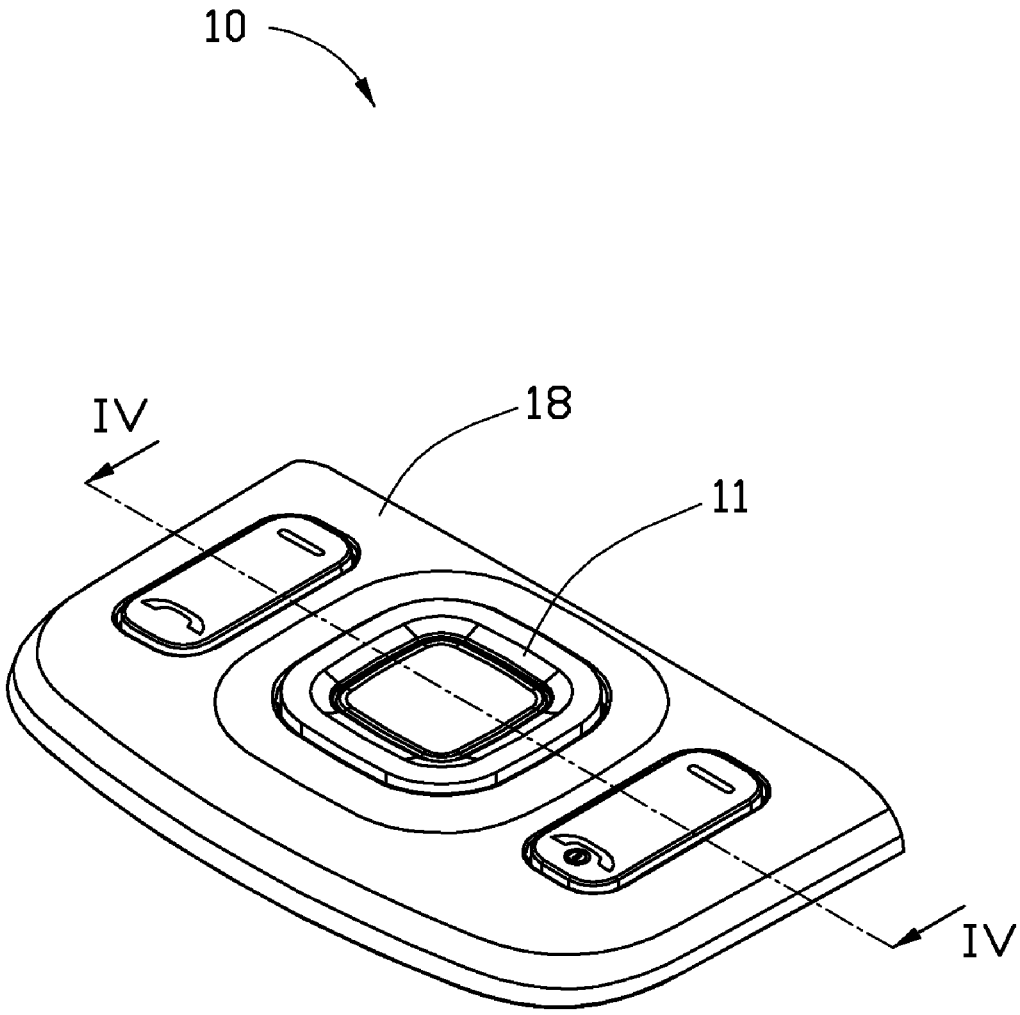
FIG. 1 is an isometric view of a key assembly for electronic devices in accordance with an exemplary embodiment.
Figure 2:
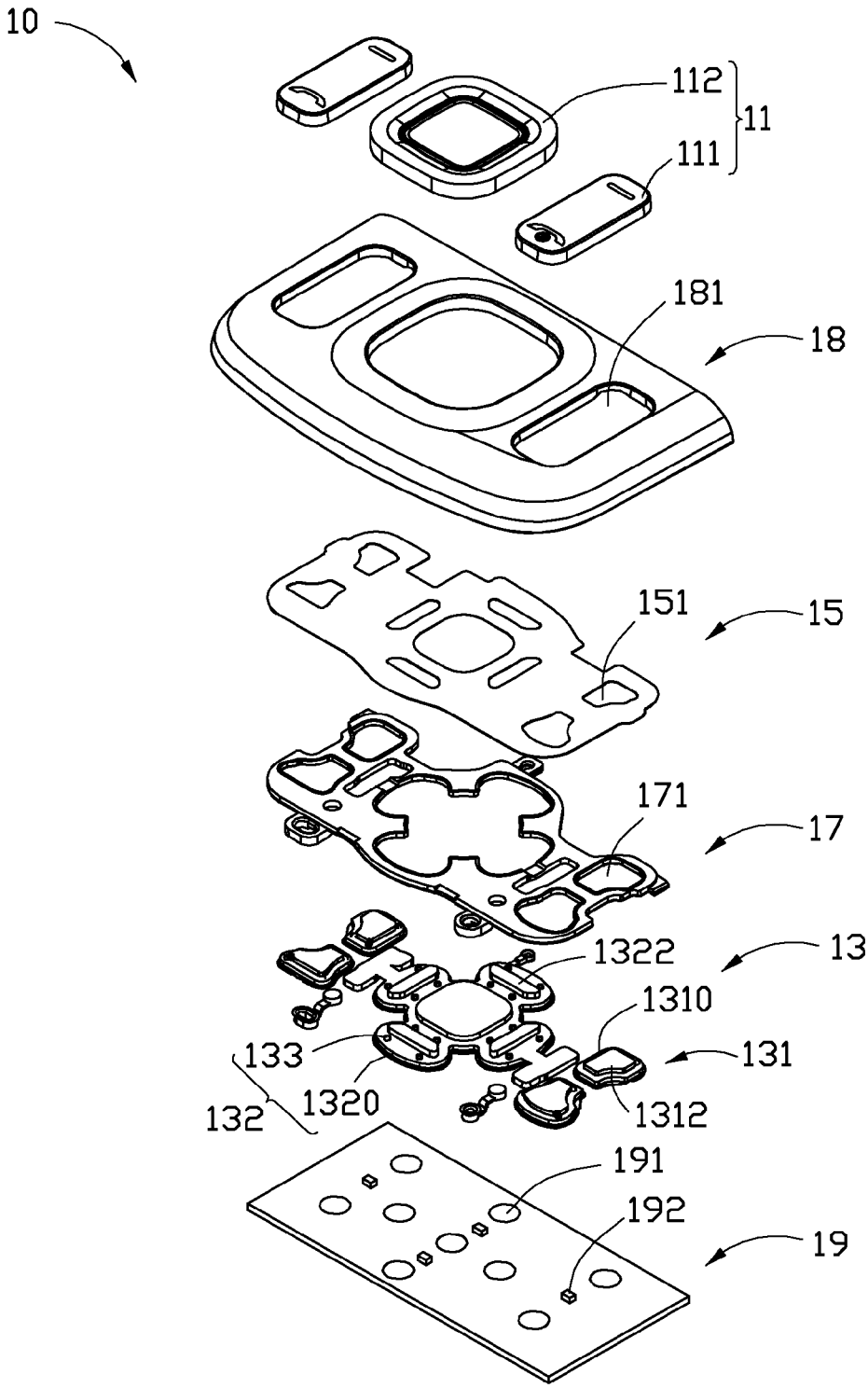
FIG. 2 is an exploded view of FIG. 1.
Figure 3:
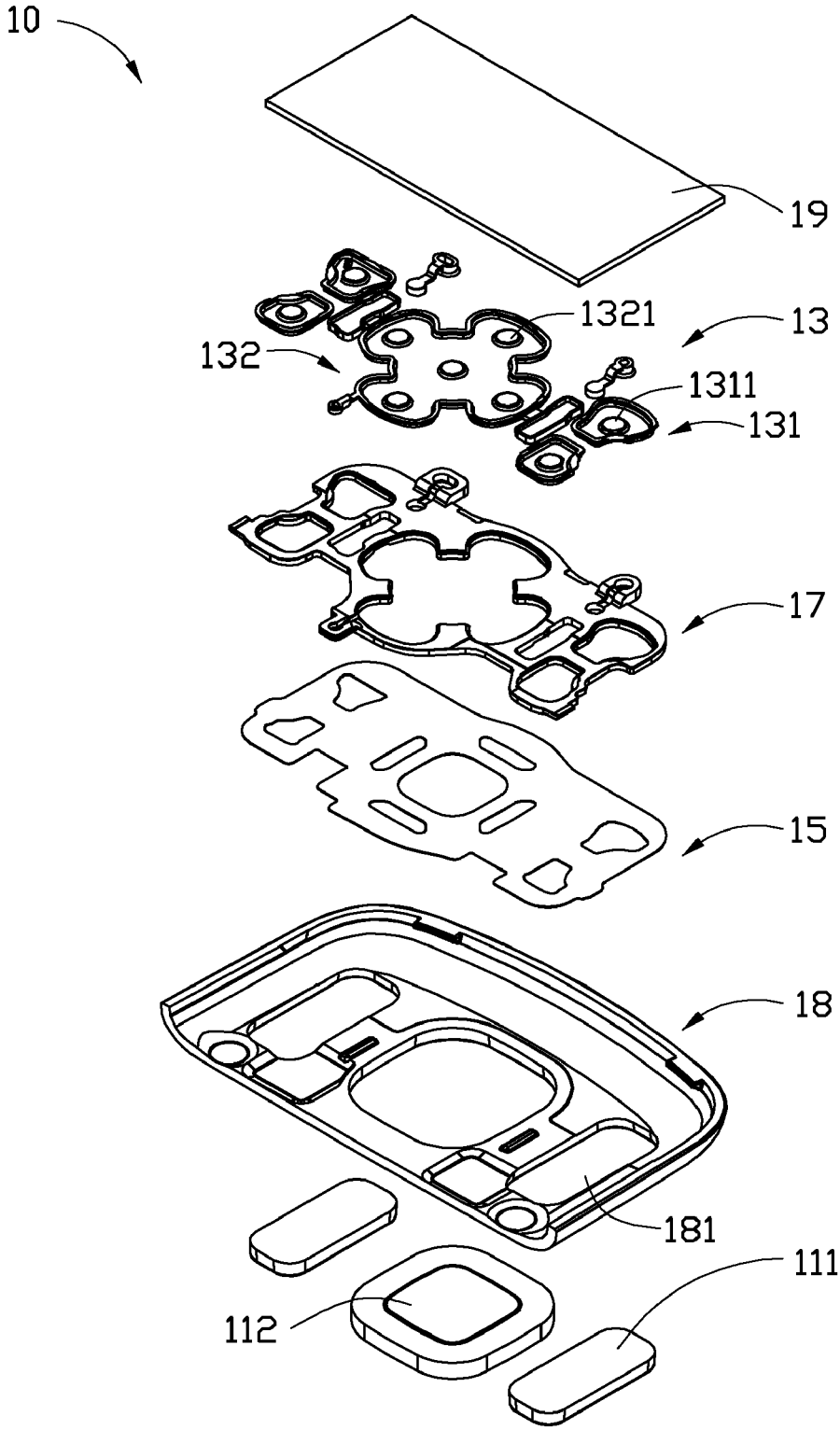
FIG. 3 is similar to FIG. 2, but shown from another aspect.

Referring to FIGS. 1, 2 and 3, show an exemplary embodiment of a keypad assembly 10 including a button cover 11, a keypad 13, a shading plate 15, a light guiding plate 17, a key seat 18, and a printed circuit board (PCB) 19.

The button cover 11 can have any shape and is to be pressed by a user. The button cover 11 includes a plurality of buttons, e.g., two first buttons 111 and a second button 112. The first buttons 111 are positioned at two sides of the second button 112. The second button 112 is a multi-directional button. The first button 111 and the second button 112 are printed with symbols, e.g., letters, figures. The button cover 11 is formed by injecting the material made of e.g., polycarbonate (PC), or other thermoplastic materials including polymethyl methacrylate and polystyrene.

The keypad 13 is made of elastic material, and can have any shape for being received in the button cover 11. The keypad 13 includes a plurality of key bodies, e.g., two pairs of first key bodies 131 and a second key body 132 corresponding to the first buttons 111 and the second button 112. Each first key body 131 includes a support portion 1310, a mounting portion 1312 and a pressing projection 1311. The mounting portion 1312 extends from one side of the support portion 1310, and the pressing projection 1311 extends from the other side of the support portion 1310. The second key body 132 includes a support portion 1320, a plurality of mounting portions 1312 and a plurality of pressing projections 1321. The mounting portions 1312 extend from one side of the support portion 1320, and the pressing projections 1321 extend from the other side of the support portion 1320. The pressing projections 1311, 1321 are to contact the printed circuit board 19. A plurality of posts 133 extend from each support portion 1310 and 1320.

The shading plate 15 can be made of an opaque, black color elastic material (e.g., the mixture of resin and carbon). The shading plate 15 defines a plurality of openings 151. Each opening 151 corresponds to the key bodies 131 and 132. The sizes of the openings 151 are smaller than the buttons 111 and 112. The posts 133 of the keypad 13 are configured to support the shading plate 15. The shading plate 15 can rebound to drive the button cover 11 back to it's previous position.

The light guiding plate 17 has a plurality of first holes 171. Each first hole 171 corresponds to the key bodies 131 and 132. The light guiding plate 17 is positioned between the shading plate 15 and the keypad 13. The light guiding plate 17 can be made of one or more materials selected from a group consisting of polyvinyl chloride (PVC), polycarbonate, polystyrene, or any other thermoplastic resins.

The key seat 18 is a portion of a housing of the electronic device, and defines a plurality of second holes 181 for receiving the button cover 11. The shading plate 15 may prevent light from leaking from a clearance between the key seat 18 and the button cover 11.

The PCB 19 includes a plurality of elastic contacts 191 and lamps 192. Each lamp 192 is arranged adjacent to a corresponding contact 191. In the exemplary embodiment, the lamps 192 are light emitting diodes (LEDs). Spaced from and aligned with the corresponding contacts 191 are the pressing projections 1311 and 1321.

Figure 4:
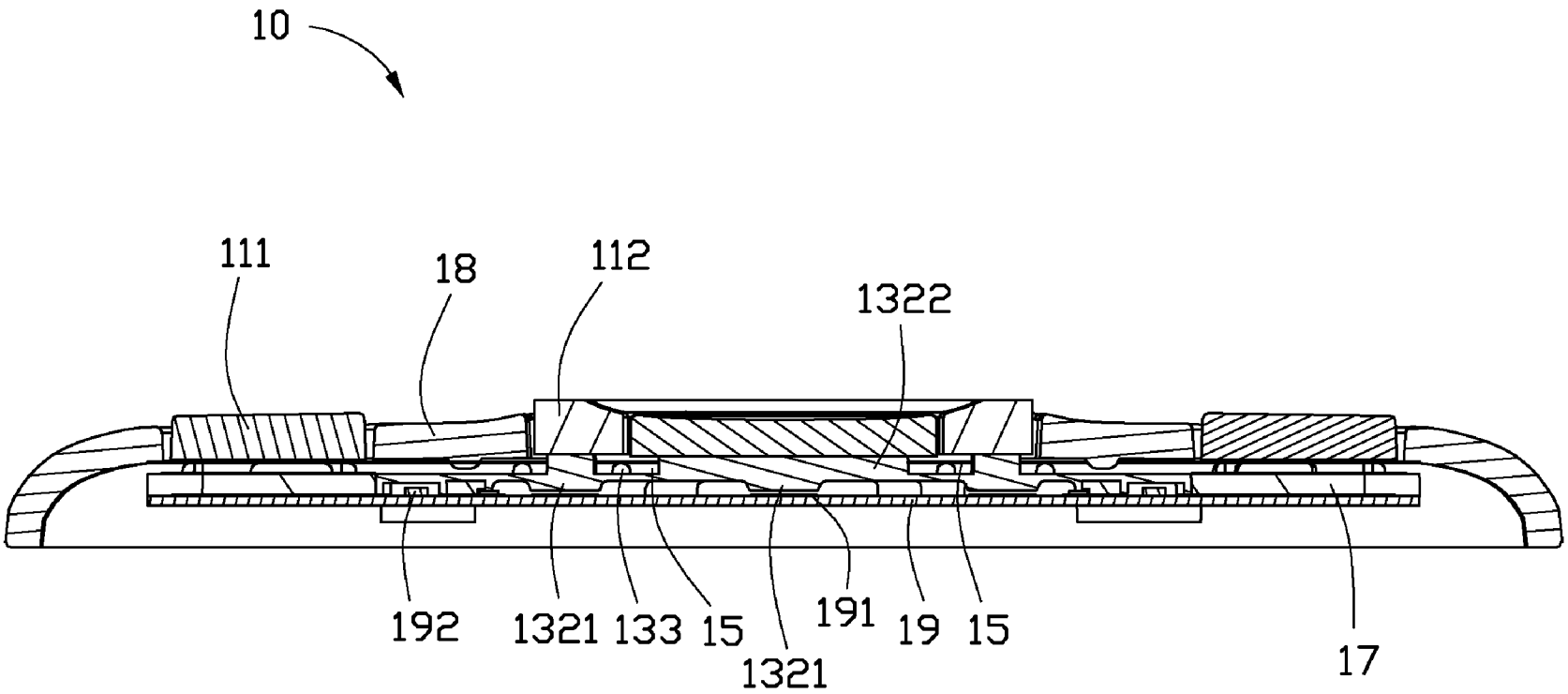
FIG. 4 is a cross sectional view of the key assembly of FIG. 1 along line IV-IV.

Referring to FIG. 4, to assemble the key assembly 10, the key bodies 131, 132 are engaged in the first holes 171 of the light guiding plate 17. The shading plate 15 is positioned on the light guiding plate 17, and is supported by the posts 133 of the keypad 13. The mounting portions 13121 and 322 are engaged in the opening 151. Then, the keypad 13 with the light guiding plate 17 and the shading plate 15 is arranged under the key seat 18. The mounting portions 1312 and 1322 extend into the second holes 18 of the key seat 18. The buttons 111 and 112 are covered on the mounting portions 1312, 1322. The assembled process is finished.

In use, when the button cover 11 is pressed downward, the shading plate 15 is pushed to deform. The keypad 13 moves towards the corresponding contacts 191 of the PCB 13, until the pressing projections 1311 and 1321 press the contacts 191 to trigger an input signal. Then, the button cover 11 is released, the shading plate 15 rebounds and drives the button cover 11 to resume to its previous shape. Since the sizes of the openings 151 are smaller than the buttons 111 and 112, the shading plate 15 prevents the light of lamps 192 from leaking from a clearance between the key seat 18 and the button cover 11. Additionally, the shading plate 15 may rebound and drive the button cover 11.

It is to be understood, however, that even through numerous characteristics and advantages of the present disclosure have been set forth in the foregoing description, together with details of assembly and function, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A keypad assembly comprising:

a button cover including a plurality of buttons;

a keypad including a plurality of key bodies respectively corresponding to the buttons, a plurality of posts arranged on the keypad, each key body comprising a support portion, a mounting portion and a pressing projection, the mounting portion extending from one side of the support portion, and the pressing projection extending from the other side of the support portion; and a shading plate positioned on the keypad and supported by the posts, the shading plate being positioned under the buttons for preventing light leakage.

2. The keypad assembly as claimed in claim 1, wherein the posts extend from each support portion.

3. The keypad assembly as claimed in claim 1, wherein the shading plate is made of an opaque, black color elastic material.

4. The keypad assembly as claimed in claim 1, wherein the shading plate defines a plurality of openings, each opening corresponds to the key bodies, the sizes of the openings are smaller than those of the buttons.

5. The keypad assembly as claimed in claim 1, further comprising a printed circuit board, the printed circuit board includes a plurality of contacts, the contacts being respectively aligned with the key bodies.

6. The keypad assembly as claimed in claim 5, wherein the printed circuit board includes a plurality of lamps, a lamp is adjacent to each contact.

7. A portable electronic device incorporated with a keypad assembly, the keypad assembly comprising:

a button cover including a plurality of buttons;

a keypad including a plurality of key bodies respectively corresponding to the buttons, a plurality of posts arranged on the keypad, each key body comprising a support portion, a mounting portion and a pressing projection, the mounting portion extending from one side of the support portion, and the pressing projection extending from the other side of the support portion;

a shading plate positioned on the keypad and supported by the posts, the shading plate being positioned under the buttons; and a printed circuit board including a plurality of contacts, the contacts being respectively aligned with the key bodies.

8. The portable electronic device as claimed in claim 7, wherein the shading plate can be made of an opaque, black color elastic material.

9. The portable electronic device as claimed in claim 7, wherein each key body includes a support portion, a mounting portion and a pressing projection, the mounting portion extends from one side of the support portion, and the pressing projection extends from the other side of the support portion.

10. The portable electronic device as claimed in claim 9, wherein the posts extend from each support portion.

11. The portable electronic device as claimed in claim 7, wherein the shading plate defines a plurality of openings, each opening corresponds to the key bodies, the sizes of the openings are smaller than those of the buttons.

* * * * *